US008978213B2

(12) United States Patent
Hayton

(10) Patent No.: US 8,978,213 B2
(45) Date of Patent: Mar. 17, 2015

(54) CLAMPING BUCKLE FOR BELTS AND STRAPS

(71) Applicant: Paul J. Hayton, Brampton (CA)

(72) Inventor: Paul J. Hayton, Brampton (CA)

( * ) Notice: Subject to any disclaimer, the term of this patent is extended or adjusted under 35 U.S.C. 154(b) by 150 days.

(21) Appl. No.: 13/644,030

(22) Filed: Oct. 3, 2012

(65) Prior Publication Data

US 2013/0097817 A1 Apr. 25, 2013

Related U.S. Application Data

(60) Provisional application No. 61/546,937, filed on Oct. 13, 2011.

(51) Int. Cl.
*A44B 1/04* (2006.01)
*A44B 11/06* (2006.01)

(52) U.S. Cl.
CPC ..... *A44B 11/06* (2013.01); *A44D 2203/00* (2013.01)
USPC ..... 24/303

(58) Field of Classification Search
CPC ..... A44D 3/00; A44F 1/002; A44C 5/2071
USPC ..... 24/303; 63/900, 29.2; 292/251.5
See application file for complete search history.

(56) References Cited

U.S. PATENT DOCUMENTS

| | | | | |
|---|---|---|---|---|
| 2,389,298 | A | 11/1945 | Ellis | |
| 2,840,875 | A | 7/1958 | Chambers | |
| 5,367,891 | A * | 11/1994 | Furuyama | 63/29.2 |
| 5,682,653 | A | 11/1997 | Berglof | |
| 6,409,656 | B1 | 6/2002 | Sangouard | |
| 6,886,724 | B2 | 5/2005 | Hung | |
| 6,954,968 | B1 | 10/2005 | Sitbon | |
| 7,065,841 | B2 * | 6/2006 | Sjoquist | 24/303 |
| 7,784,655 | B2 | 8/2010 | Su | |
| 7,889,036 | B2 * | 2/2011 | Fiedler | 335/306 |
| 2010/0018008 | A1 * | 1/2010 | Ahn | 24/303 |
| 2010/0287741 | A1 * | 11/2010 | Fiedler | 24/303 |
| 2011/0083254 | A1 * | 4/2011 | Trutna et al. | 2/326 |
| 2012/0131967 | A1 | 5/2012 | Snchez | |
| 2013/0276269 | A1 * | 10/2013 | Su | 24/303 |

FOREIGN PATENT DOCUMENTS

| | | |
|---|---|---|
| CN | 201349612 | 11/2009 |
| EP | 1365668 | 1/2002 |

* cited by examiner

*Primary Examiner* — Victor Batson
*Assistant Examiner* — Matthew Sullivan
(74) *Attorney, Agent, or Firm* — Jeffrey S. Melcher; Manelli Selter PLLC

(57) ABSTRACT

A buckle for use with a belt or with strapping in which the bucket uses magnetic attraction forces to apply a clamping force on the belt or strap, when the buckle assembly components are in a first predetermined orientation. Typically, a plurality of magnets is used, and when the buckle assembly is rotated to a second predetermined position, the magnets are moved from a state where they attract one another, to a position where they repel one another. In this second predetermined orientation, the buckle components are forced apart by the repulsive forces so as to create a larger gap between the buckle components, and thus allow the belt or strap material to move freely within the gap. The buckle is preferably held in the second predetermined orientation by a restraint device such as a pin located within a recess on the corresponding rotating assembly. However, a slight depression and rotation of the buckle moves the buckle components out of the restraint device, and allows the magnets to effect rotation of the buckle assembly back to the first orientation position, and thus, decrease the size of the gap between the buckle components. This once again clamps the belt or strap material within the gap. A simple magnetic clamping device is provided.

15 Claims, 6 Drawing Sheets

47a
21
32
22
36
20
34
47

20
21
22

34
20
36

20
21
47a
21
47
34

20
38
32
34
36
32
38

20
22

32
38
34
36
34
38
32
20

47

CLAMPING BUCKLE FOR BELTS AND STRAPS

FIELD OF THE INVENTION

This invention relates to buckles, such as belt buckles and buckles that may be used to secure certain kinds of strapping, wherein the belt or strap is made of a material through which a magnetic field will pass, and wherein the clamping action of the buckle which secures the belt or strap in place comes as a consequence of establishment of a magnetic field and attraction between two principal component assemblies of the buckle.

BACKGROUND OF THE INVENTION

Belt buckles have been known for ages, and typically include a prong or tongue which passes through an opening or hole formed through the material of the belt—usually leather, in order to hold the belt material in place. Other types of buckles, or more generally, closures, have also been employed for use with belts, strapping or the like, and typically require the use of a mechanical compression device, or some other mechanism, in order to secure them in place by clamping down on the belt or strapping.

Especially with belt buckles, and more particularly with belt buckles used together with leather belts—which is by far the most common usage of such buckles—the fact that the prong or tongue of the buckle must pass through an opening or hole in the belt or strap, means that adjustment of the belt around the waist of the wearer is not fine, because the space between the holes is typically in the range of 1 cm up to 3 cm, or so.

The inventor herein has unexpectedly discovered that, with the proper assembly of non-magnetic frame components, magnetic flux plates, and/or planar magnets, an extremely strong clamping action can develop between the two principal component assemblies of the buckle. This effect is provided, however, only when the material with which the buckle is employed permits the passage therethrough of a magnetic field. Certainly, leather belts and/or and fabric or plastic belts and strapping meet this criterion.

Moreover, the present invention takes advantage of the fact that with the employment of a number of relatively strong but small planar magnets, that if the magnets are presented in coordinated sets, and the sets are physically placed so that the face of one planar magnet having, say, the north pole thereat is held a short distance (e.g. 0.2 to 2 cm) away from the face of another magnet having the south pole thereat, there is a strong magnetic attraction between the magnet sets. While any suitable magnets might be used, such as ceramic magnets, or other permanent magnets, a most preferred form of magnet is a higher strength permanent magnet, is preferred. Most preferably, the magnet is a "Neodymium" magnet, or more precisely, a neodymium iron boron (NdFeB) magnet, which is known to those skilled in the art of magnets.

With the use of this type of magnet, the magnets used in the practise of the present invention, can be relatively small, namely, that each of the magnets used typically have a diameter of from about 5 mm to 25 mm, and more preferably, from about 8 mm to about 12 mm.

When the magnets are placed in a face-to-face arrangement, and having opposite polarity, the attractive forces between the magnets is used to create a clamping action, and thus hold the buckle assemblies together.

If the magnets are slightly offset, this attraction force will also cause a sideways motion of one of the magnets with respect to the other, so that the respective north and south poles will either come into contact with one another, if permitted, or at least move to a position where they will face one another, if the magnets are held apart. Further, this would be true regardless of whether a typical belt or strapping material is placed between the magnets through which the magnetic field of each of the magnets is permitted to pass.

Additionally, if two such planar magnets are physically placed so that the north or south poles of each magnet face each other, there will be a strong physical repulsion between the magnets, and there must be a constraint or restraining means provided so as to keep the magnets from flying apart.

Thus, in the present invention, it would be advantageous to provide a belt or other strapping buckle, that operates by use of the attraction and repulsive forces of magnets, and thus allow fine control of the positioning of the belt or strap being clamped.

A further advantage of the present invention would be to provide such a buckle that operates easily, and moves from a magnetic repulsive position to a magnetic attraction position, with minimal effort. It is a preferred feature that the buckles of the present invention move from a open to a closed position, by use of the characteristics of the magnets employed.

SUMMARY OF THE INVENTION

The advantages set out hereinabove, as well as other objects and goals inherent thereto, are at least partially or fully provided by the buckle of the present invention, as set out herein below.

Accordingly, in one aspect, the present invention provides a clamping buckle for non-magnetic belts and straps through which belts and straps a magnetic field will pass, comprising:

an optional outer escutcheon plate;

an optional first magnetic flux plate;

a set of at least two, preferably planar, first magnets, each having a north pole and a south pole at opposed planar faces;

a buckle plate preferably having the same number of openings formed therein as there are first planar magnets, and wherein each opening is sized so as to accommodate one magnet;

a set of at least two, preferably planar, second magnets, each having a north pole and a south pole at opposed planar faces;

a base plate preferably having the same number of openings formed therein as there are second planar magnets, and wherein each opening is sized so as to accommodate one magnet; and an optional second magnetic flux plate;

wherein, when assembled and in its clamping condition, the north poles of the first planar magnets are in facing relation and magnetic attraction to the south poles of the second planar magnets, and vice versa, with a opening between said buckle plate and said base plate, for a belt or strap to be positioned therebetween;

wherein the buckle plate, the base plate, and preferably the escutcheon plate, are all preferably made of a non-magnetic material, and the optional first and second flux plates are preferably made of a magnetic material;

wherein said escutcheon plate and said buckle plate are secured to each other with said first set of planar magnets being secured therebetween, so that the assembly of said escutcheon plate and said buckle plate may be rotationally moved from a first predetermined orientation were said clamping condition exists to a second predetermined orientation were no clamping condition exists, and wherein, in the second predetermined orientation the north poles of said first planar magnets are in facing relation to the north poles of said second planar magnets and the south poles of said first planar magnets are in facing relation to the south poles of said second planar magnets, so that magnetic repulsion exists between said first set of magnets and said set of second magnets;

wherein restraining means is provided on said base plate so as to preclude complete separation of said assembly of said escutcheon plate and said buckle plate from said base plate, but so as to provide a gap between said buckle plate and said base plate through which a belt or strap may be passed; and wherein slight rotational movement of said assembly of said escutcheon plate and said buckle plate from said second predetermined orientation will permit a sideways magnetic attraction between north and south poles of the respective first and second planar magnets to become effective, so as to thereby permit continued rotational movement of said assembly of said escutcheon plate and said buckle plate toward said first predetermined orientation, whereat the north and south poles of the respective first and second sets of planar magnets face each other, and vice versa, whereby the magnetic attraction therebetween will cause the escutcheon plate and buckle plate assembly to physically move toward said base plate so as to thereby establish a clamping action therebetween against a belt or strap which has been passed through said gap.

The present invention further provides that there will preferably be an equal and even number of planar magnets in each set of said first and second magnets. In particular, the present invention preferably requires that there may be two, four, six, eight, or more, planar magnets in each set of said first and second planar magnets. In a further preferred embodiment, the magnets are placed in substantially alternating polarity arrangement of north, south, north, south, and the like.

Typically, the escutcheon plate, buckle plate, and base plate, are made of non-magnetic materials, such as aluminum for example, but they may also be made from suitable non-magnetic materials such as ceramics, wood, plastics, ivory, bone, or the like. Most preferably, however, these components are all made of aluminum or a suitable hard plastics material.

When there are at least four planar magnets in each of said first and second sets of planar magnets, they are preferably sized and arranged around a face of the respective magnetic flux plate so that an outer portion of each magnet is at least proximate to the outer circumference of the respective magnetic flux plate; and so that the respective planar faces of adjacent planar magnets are alternately north and south poles and so that the respective planar faces of the adjacent magnets which are magnetically secured to the respective magnetic flux plate are alternately south and north poles, respectively.

The magnets are typically separate items to be placed into the clamping buckle, but can also be a single larger disc of a Neodymium, which has zones of different magnetic polarity. As such, a single disc of a multi-zoned Neodymium magnet could replace a plurality of separate magnets.

A feature of the present invention is that detent means may be provided so as to preclude inadvertent rotational movement of said assembly of said escutcheon plate and said buckle plate from said second predetermined orientation. This can be achieved by, for example, the use of recesses or indentations on the buckle plate, together with corresponding pins, or other protrusions, on the base plate which are adapted to fit into the recesses or indentations, when the buckle is in the second predetermined orientation.

As such, in a preferred embodiment, the buckle plate rotates with respect to the base plate, to a point where the buckle plate is in the second predetermined orientation. At this point, the pins or protrusions are aligned with the recesses or indents, and the magnets are in their repulsive positions. As a result, the buckle plate is forced further away from the base plate, so that the pins or protrusions on the base plate become fitted within the recesses or indents on the buckle plate.

Furthermore, by applying slight pressure on the buckle plate and a slight rotational force, the pins and protrusions are moved out of the indents, and thereby permit the magnets to cause a further rotational movement back towards said first predetermined orientation. As a result, the buckle plate snaps back to the first predetermined position, and clamps down on the belt or strapping positioned between the base plate and the buckle plate, as previously described.

Of course, this arrangement of the pins and recesses, and the like, can be reversed between the base plate and the buckle plate.

DETAILED DESCRIPTION OF THE INVENTION

In the present application, the term "magnet" refers to a material which provides a magnetic field. This would include permanent magnets, such as the preferred Neodymium magnets. The term "magnetic" is used to describe materials which are not magnets, but are attracted to a magnet by the magnetic forces. Devices made of steel, or the like, would be included in this category. The term "non-magnet" refers to materials which are not substantially attracted or repelled by the magnetic forces from the magnets.

The present application is primarily directed to the use of magnets in a non-magnetic housing, but which does preferably include magnetic plates, or the like, to facilitate positioning of the magnets, or the like.

Unless otherwise specifically noted, all of the features described herein may be combined with any of the above aspects, in any combination.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention.

Also, throughout the following discussion, it will be understood that the same or similar components are identified by the same reference numerals.

Figure 1:
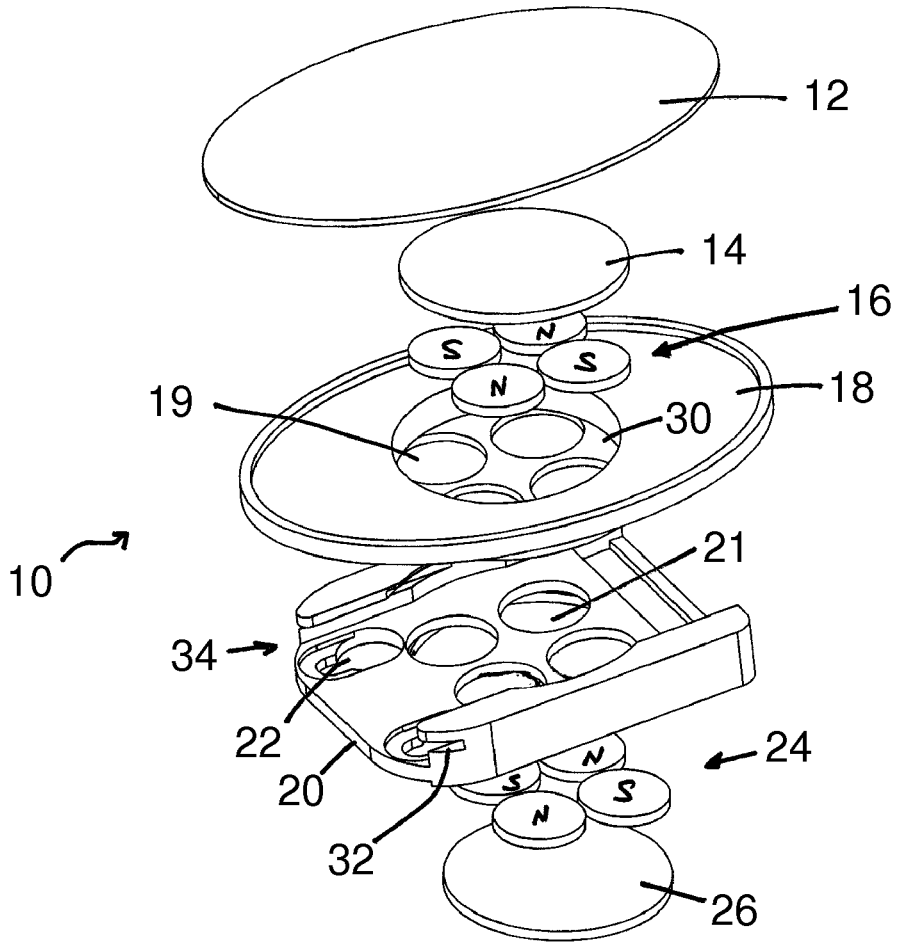
Figures 2A, 2B, 2C, 2D, 2E, 2F, 2G, 2H:
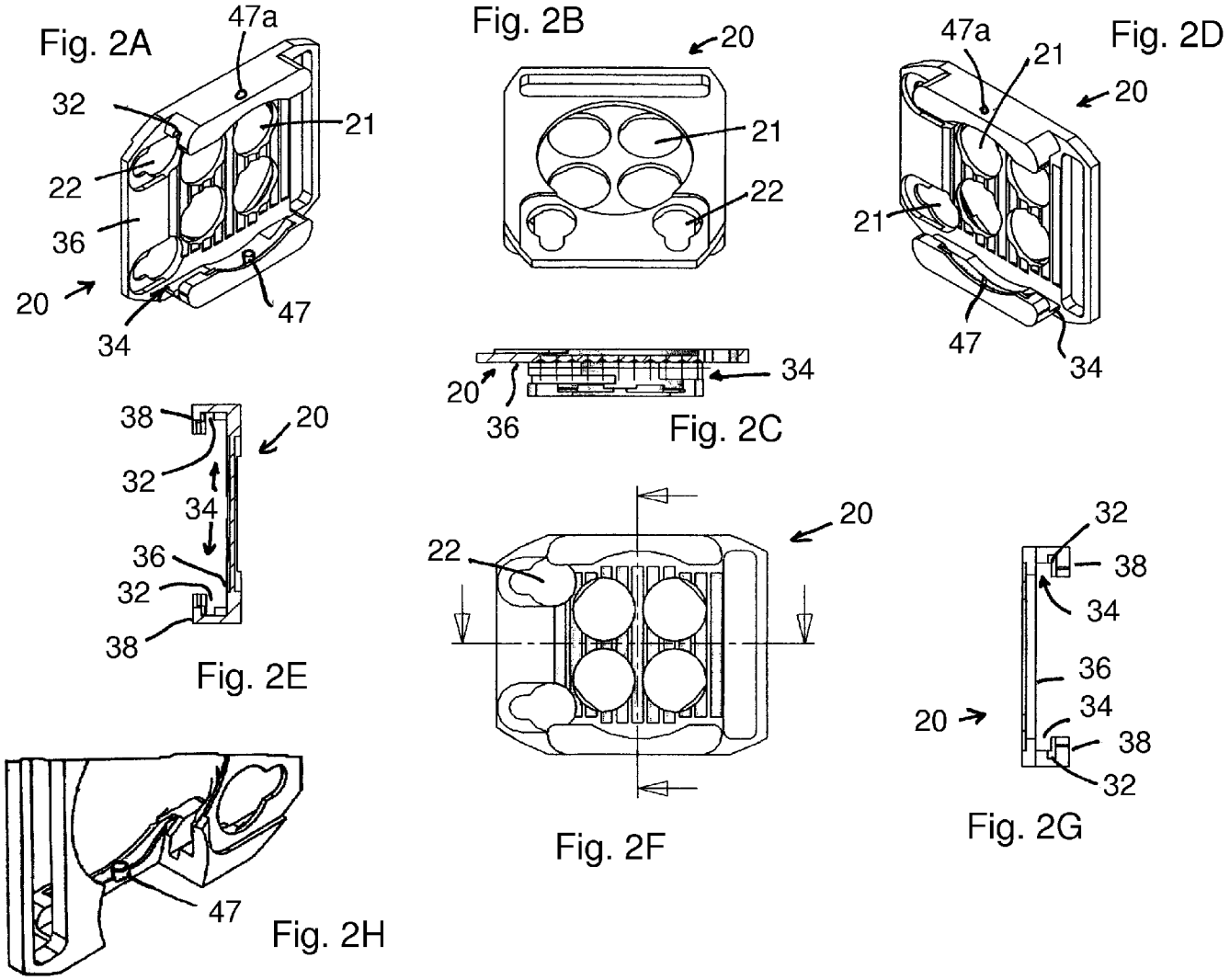
Figure 6A:
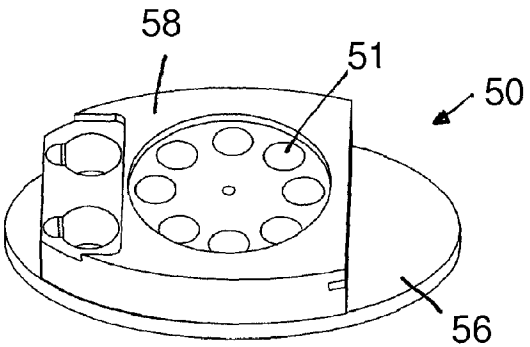
Figure 6B:
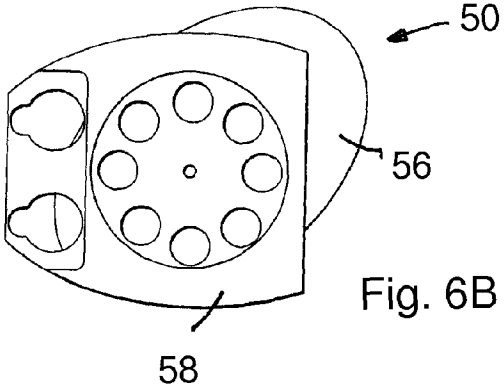
Figure 5:
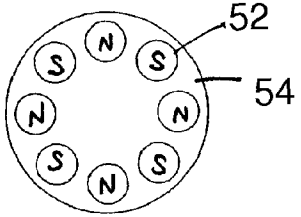
Figure 4:
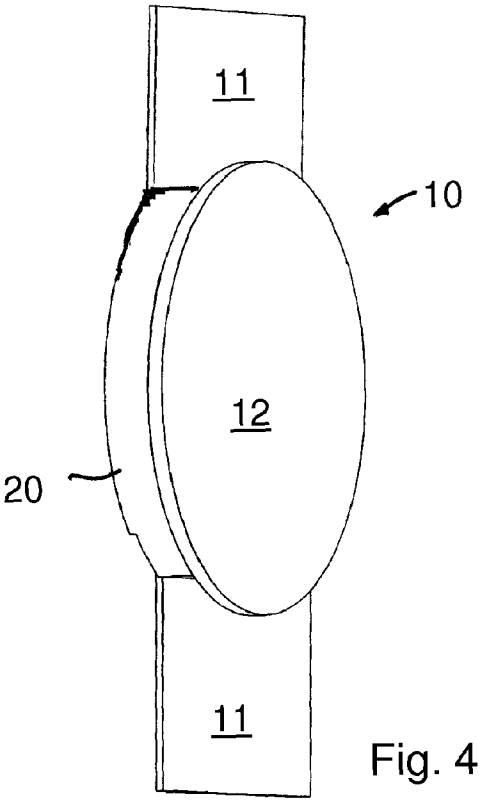
Figure 7C:
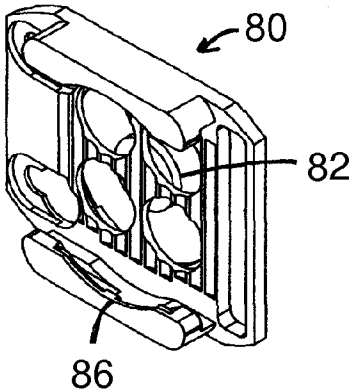
Figure 7F:
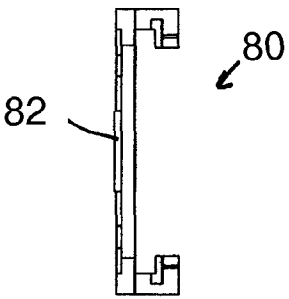
Figure 7B:
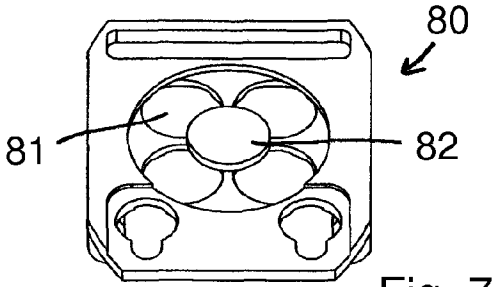
Figure 7D:
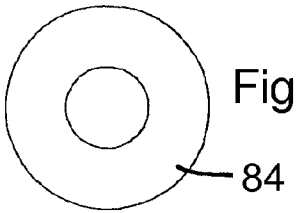
Figure 7E:
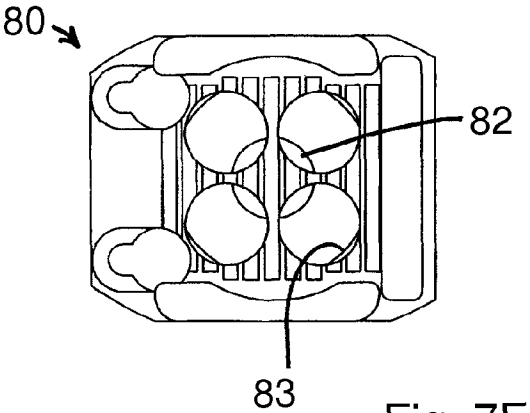
Figure 7A:
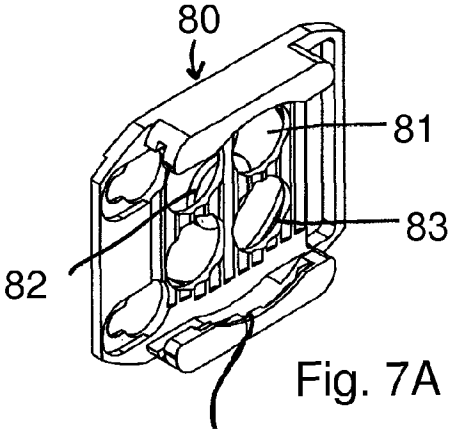
Figure 7G:
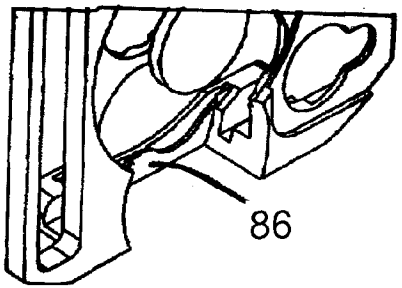
Figure 8C:
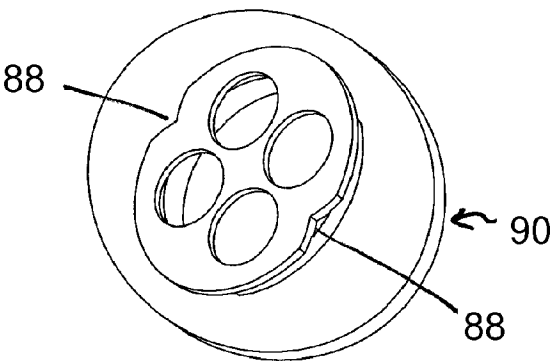
Figure 8F:
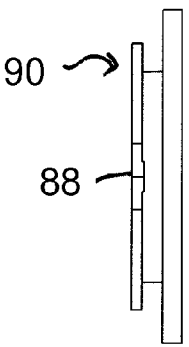
Figure 8B:
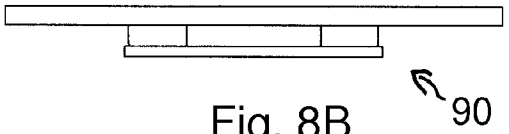
Figure 8E:
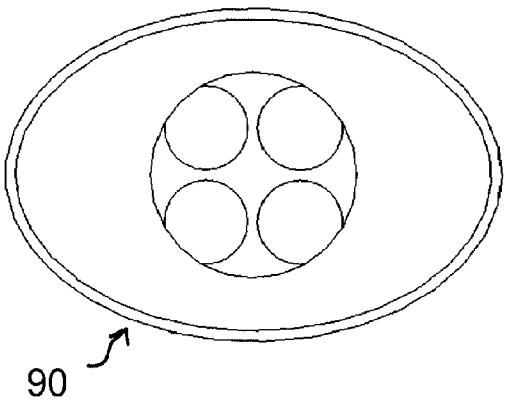
Figure 8A:
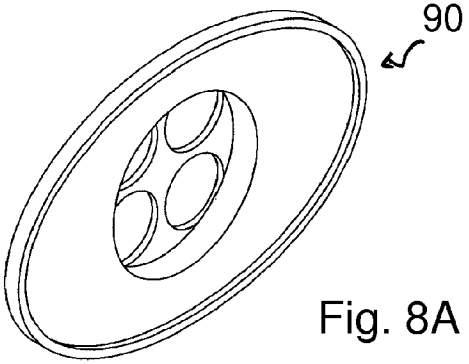
Figure 8D:
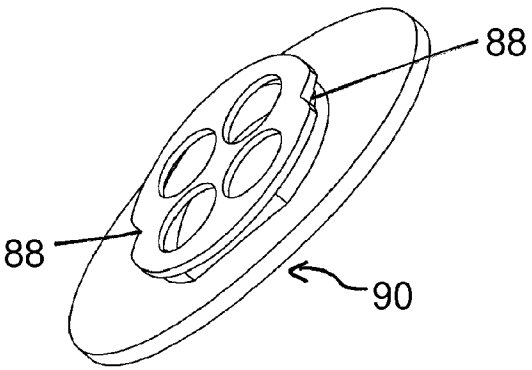

Embodiments of this invention will now be described by way of example in association with the accompanying drawings in which:

FIG. 1 is an exploded view of a first embodiment of a belt buckle in keeping with the present invention;

FIGS. 2A through 2H provide a plurality of views of a base plate of the embodiment of the belt buckle shown in FIG. 1;

FIGS. 3A through 3F provide a plurality of views of a buckle plate of the embodiment of the belt buckle shown in FIG. 1;

FIG. 4 provides a view of a typical belt buckle in keeping with the present invention when assembled to a belt;

FIG. 5 provides a view of a belt buckle in keeping with a second embodiment of the present invention;

FIGS. 6A and 6B provide views of the embodiment of FIG. 5, wherein the principal components of the embodiment of FIG. 5 are arranged in the first and the second predetermined orientations as defined herein;

FIGS. 7A through 7G provide a plurality of views of a base plate according to a third embodiment; and FIGS. 8A through 8F provide a plurality of views of a buckle plate according to the third embodiment of the buckle of the present invention.

DETAILED DESCRIPTION OF THE PREFERRED EMBODIMENTS

Referring first to FIG. 1, a typical embodiment of a buckle is shown. While the present invention can be used with strapping (such as nylon strapping, or the like), FIG. 1 is directed to a belt buckle, generally shown at 10. The principal components of buckle 10 are:

a buckle plate 18 having 4 openings 19 therethrough, an optional escutcheon plate 12, a first flux plate 14, and a first set of planar magnets 16; and a base plate 20 having four openings 21 therethrough, a second set of planar magnets 24, and a second flux plate 26.

In more specific detail, FIG. 1 shows, first, an escutcheon plate 12 upon which any kind of design, or none at all, may be placed. For example, initials might be placed on the escutcheon plate, the logo of a sports team or club, and so on. Since the escutcheon plate 12 is typically worn at the waist, and as will be seen hereafter is the outward most component of the belt buckle 10, it can be used as an ornamental accessory, or not. In any event, the escutcheon plate 12 is secured to the buckle plate 18 by use of any suitable materials, such as by suitable adhesives or the like. Alternatively, the escutcheon plate may be formed as part of the magnetic flux plate, or may be formed integral thereto. Within the assembly of the escutcheon plate 12 and the buckle plate 18 there is placed the first magnetic flux plate 14 and a plurality (that is, at least two) of planar Neodymium magnets identified as a group at 16. Each magnet has a general appearance of a button cell battery, but in this case each magnet is generally quite highly magnetized with one of its planar surfaces presenting a north pole of the magnet, and the other planar surface presenting a south pole of the magnet. For the buckle plate 18 shown, four magnets 16 are shown, which are adapted to be fitted within openings 19.

The flux plate 14 is optional, but it is preferred since it assists in locating and holding the magnets 16 in place.

It is seen that the magnets are placed so that each adjacent magnet presents the opposite pole. In this case, beginning with the magnet shown at the upper left as seen on the drawing, and going clockwise therefrom, the upward facing poles of the magnets 16 are south, north, south, north; so that the downward facing poles of the same magnets, starting at the same upper left magnet, are north, south, north, south. It is also noted that a recess 30 is formed in the buckle plate 18, having the openings 19 formed therethrough, so that the magnets 16 are accommodated in the openings 19 and their lower faces (as seen in the drawing) are substantially coplanar with the bottom surface of buckle plate 18. Flux plate 14 is then fitted within recess 30, and escutcheon plate 12 attached overtop.

This assembly of the escutcheon plate 12, the buckle plate 18, together with the first magnetic flux plate 14 and the magnets 16, forms a first principal component of buckle 10.

The other principal component of the buckle 10 comprises the base plate 20, through which four openings 21 are formed, so as to receive a second set of planar magnets 24 and an optional second flux plate 26. The magnets 24 are placed within openings 21, and then covered with flux plate 26, in a manner similar to that described with respect to the magnets 16 and flux plate 14 in buckle plate 18.

Openings 22 at one end of base plate 20 permit the buckle 10, or more specifically, the base plate 20 thereof, to be secured to one end of a belt or strap, using any suitable means, such as by suitable rivets, or the like (not shown).

It will be noted in FIG. 1 that the placement of the planar magnets 24 on the second flux plate 26 is such that the south poles of those magnets will face the north poles of the magnet set 16, and vice versa (in the first orientation arrangement), so that when they are in the spatial juxtaposition one to another as shown in FIG. 1, there will be a significant magnetic attraction between the first magnet set 16 and the second magnet set 24, thereby urging the assembly of the escutcheon plates 12 and buckle plate 18 to move towards the base plate 20, and vice versa. If the other end of the belt or strap is placed between the first magnet set 16 and the second magnet set 24, and that material will permit the passage of the magnetic field therethrough, then a significant clamping force against the material will develop.

Since the clamping force can be applied at any point on the belt or strap material, this buckle arrangement permits small, incremental adjustments to the placement of the belt or strapping material lengthwise of the belt buckle.

Referring to FIGS. 2A to 2H, a plurality of views of base plate 20 is shown. The additional features of base plate 20 which are evident in FIGS. 2A to 2H are a slot 32 within a wider gap 34 formed between a surface 36 and an inturned lip of a shoulder 38. The purpose of the slot 32 is to permit passage of a lip of the buckle plate 18 (as discussed in respect of FIGS. 3A to 3F), which may also have an additional slot formed therein and either or both sides thereof, whereby buckle plate 18 may be captured and held in place relative to the base plate 20. However, gap 34 is large enough to also permit passage therethrough of the fabric of a belt or strap, prior to its being magnetically clamped in place as will be described hereafter.

Figure 3C:
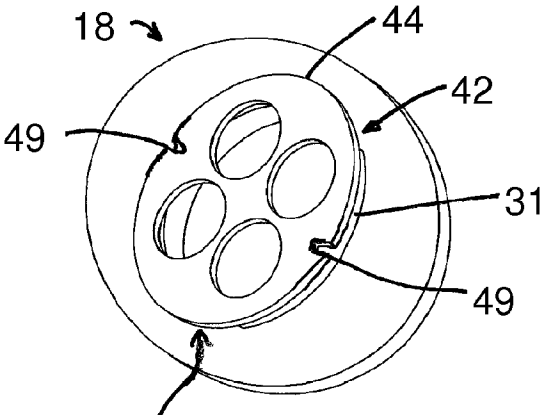
Figure 3F:
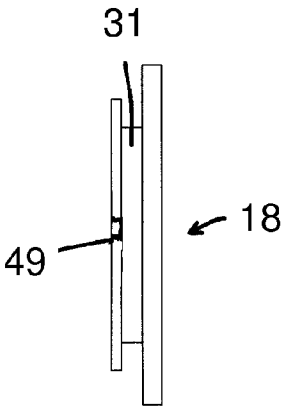
Figure 3B:
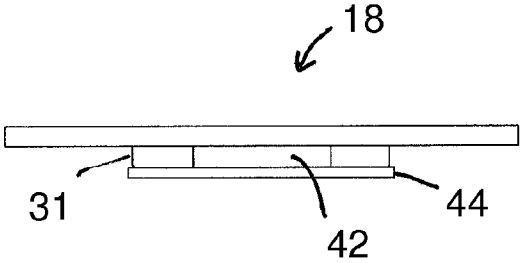
Figure 3E:
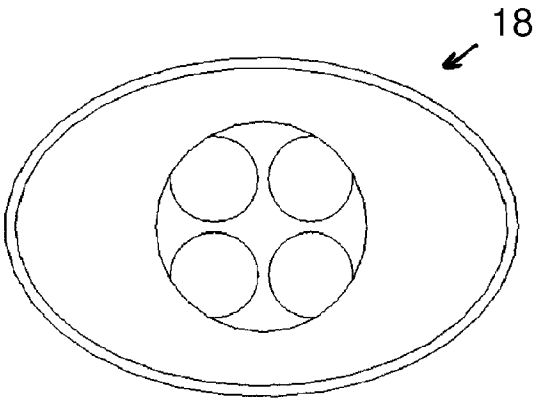
Figure 3A:
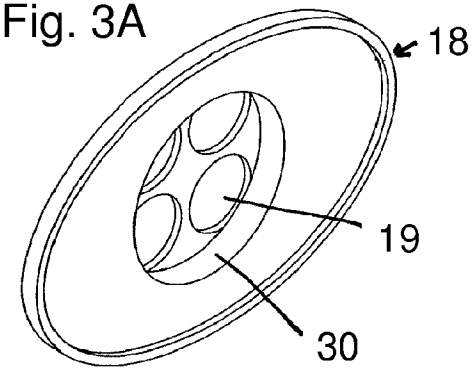
Figure 3D:
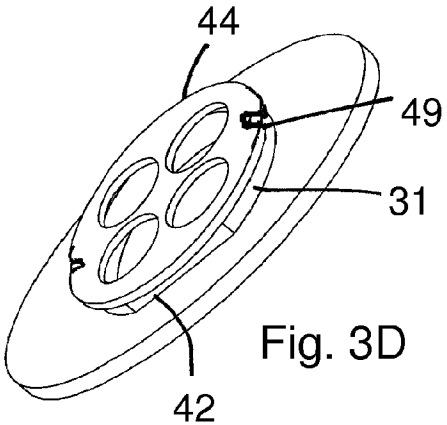

A pin 47 on base plate 20, is shown which is adapted to be fitted into a corresponding recess 49 (seen in FIGS. 3C, 3D and 3F). Pin 47 is pressed into position through the side of base plate 20, and the fixed end of pin 47*a* can be seen in FIGS. 2A and 2D. A better view of pin 47 can be seen in FIG. 2H, which is a partial cutaway view of base plate 20, with a reverse view from the view shown in FIG. 2A.

Referring to FIGS. 3A to 3F, a plurality of views of the buckle plate 18 is shown. The features of buckle plate 18 are as hereinabove described with respect to FIG. 1. Additionally though, it is seen that a surface 31 on the outer periphery of recess 30 is provided, which is subtended by a lip 44. A pair of flat surfaces 42 on opposite sides (and opposing sides) of surface 31 are formed, so that when buckle plate 18 is assembled to the base plate 20, lip 44 can be accommodated in the slots 32 while buckle plate 18 is in one orientation; and upon turning the buckle plate 18 relative to the base plate 20, the buckle plate 18 is restrained in place so that complete separation of the assembly of buckle plate 18 away from base plate 20, is precluded.

Recesses 49 are provided so as to interact with corresponding pins 47 on buckle plate 20. When rotated to its second orientation, the action of inserting pins 47 into recesses 49 acts to temporary lock buckle plate 20 in position.

Now, it can be clearly understood that when the base plate assembly is made;—and include the second flux plate 26, the second magnet set 24, and the base plate 20; and when the assembly of the escutcheon plate 12 together with the first flux plate 14, the first magnet set 16, and the buckle plate 18, is made; and those two principal components are assembled together in the manner described immediately above so as to preclude further separation of those two principal components, then a gap will be formed in the general region of the gaps 34 in the sides of the base plate 20 above the surface 36, so that a belt or strap can be passed through that gap. Moreover, it will be understood that as soon as the orientation the of the escutcheon plate and buckle plate 18 relative to the base plate 20 is such that the north poles of the first magnet set 16 face the south poles of the second magnet set 24, and vice versa, the magnetic attraction between the two principal components will draw them together or at least towards one another until such time as the belt or strap material between them is clamped in place due to the magnetic attraction between the magnet sets 16 and 24 in buckle plate 18, and base plate 20.

In this embodiment, rotation of the buckle plate 18 by 90° will then move the buckle plate to a second orientation, wherein the magnets 16 and 24 repel one another, and thus loosen the compressive force on the strap or belt, and thus allow it to be moved, or removed from buckle 10. In fact, turning buckle plate 18 by approximately 45° will allow the repulsive forces of the magnets to decrease the clamping force between buckle plate 18 and base plate 20. Continuing rotation will increase the repulsive forces, until these forces are maximized at the second orientation, and force buckle plate 18 away from base plate 20.

Moreover, at the point where buckle plate 18 has reached its second orientation point, buckle plate 18 is free to move even further away from base plate 20, because pins 47 are aligned with recesses 49, and thus, pins 47 move into these recesses 49.

This completes the description of this embodiment of the invention, and a completed belt buckle 10, with a belt 11, is shown in FIG. 4.

A second embodiment of a belt buckle of the present invention, is shown at 50 in FIGS. 6 and 6A. Here, the principal components of the buckle 50 are essentially the same as described in FIGS. 1 to 3F, except that two sets of eight magnets each are employed. In FIG. 6A, eight openings 51, are shown.

A set of magnets shown at 52 are arrayed on a flux plate 54, as seen in FIG. 5. Because the flux plate and magnets can be identical, flux plate 54 and its associated magnets may comprise either the magnet set and flux plate which is associated with the assembly of the escutcheon plate and the buckle plate assembly 56, or with the magnet set and flux plate which is base plate 58. Once again, though, it is important to note that in the assembly of the buckle 50 of the present invention, that the north poles and the south poles of one set of magnets will normally face the south poles on the north poles, respectively, of the other set of magnets, in belt buckle 50's first predetermined orientation.

FIG. 6A illustrates this first orientation position, wherein the two principal components are aligned, and the magnets are in their magnetic attraction, first orientation.

Rotation of the escutcheon plate with respect to the base plate moves the buckle to the second predetermined orientation, as seen in FIG. 6B. Once in this position, the buckle plate 18 is repulsed from base plate 80, and the restraining device such as the pin and recess assembly, as previously described, acts to hold the buckle plate in the second predetermined orientation. Here, only a 45° rotation of the buckle plate is required to move from the first orientation position to the second orientation position.

Again, in the second orientation position, buckle plate 56 has been moved away from base plate 58, and thus, the gap between them, has widened. As such, this allows a belt (or other strapping) to be inserted into, or removed from the gap, or the position of the belt to be finely adjusted.

While in the second predetermined orientation, a slight depression of, and a slight rotational movement of the escutcheon plate and buckle plate assembly with respect to the base plate will cause pins 47 to move out of recesses 49, and allow the sideways magnetic attraction which exists between the north and south poles of the respective first and second planar magnet sets will come into effect, and thereby cause a rotational movement of the assembly of the escutcheon plate and buckle plate relative to the base plate, so as to return the buckle to the first predetermined orientation. At that time, the magnetic attraction between facing north poles and south poles, and vice versa, of the first and second magnet sets will once again come into effect, thereby creating a clamping action between them.

In FIGS. 7A to 7G, a plurality of views of a third embodiment of an alternative base plate 80 shown which includes a modified holder for the magnets. In this example, 4 openings 81 are again used. In this example, however, the restraining device, comprises a protrusion 86 on base plate 60 which will fit into an corresponding indent 88 (FIGS. 8A to 8F), when the buckle is in the second predetermined orientation. The protrusions 86 are shaped to match indent 88, and are therefore dimensioned so that they will move into indent 88, when the escutcheon plate and buckle plate assembly is moved from the first predetermined orientation into the second predetermined orientation. Again, protrusions 86 fit into indents 88 as a result of a movement of buckle plate caused by the repulsive nature of the magnets in the second orientation. Protrusions 86 are best seen in cutaway, in FIG. 7G, which is a partial cutaway view from the reverse side of FIG. 7A.

Again, though, because the escutcheon plate buckle plate assembly is secured in place in the same or similar manner as described above with respect to FIGS. 1 to 3F, the magnetic repulsion which exists in the second predetermined orientation is precluded from causing complete separation of the buckle assembly. Accordingly, the escutcheon plate/buckle plate assembly can rotate, but will not separate from the base plate assembly.

A further distinction between base plate 80 and base plate 20 is the additional of a magnet resting plate 82, formed at the center of openings 81, and shoulders 83 formed at the outer edges of openings 81. Resting plate 81, and shoulders 83, formed in base plate 80, assists in holding the magnets in place during manufacture of the buckle. Further, in place of flux plate 26, a ring-shaped flux plate 84 can be used in base plate 80, to hold the magnets in place.

Otherwise, base plate 80 acts in the same manner as base plate 20, previously described.

In FIGS. 8A to 8F, a plurality of views of a third embodiment of an alternative buckle plate 90 are shown. Buckle plate 90 is adapted for use with base plate 80 from FIGS. 7A to 7G, and includes indents 88, which are adapted to receive protrusions 86. Otherwise, buckle plate 90 acts in the same manner as buckle plate 18, previously described.

It will be realized that even when there are only two planar magnets in each magnet set, the operating principles of the present invention remains the same. When the north and south poles of the magnets face each other, an attractive force holds the buckle plate and base plate together. When the buckle plate is rotationally moved 180°, so that north poles face each other, and/or the south poles face each other, there will be magnetic repulsion. When the escutcheon plate and buckle plate assembly is rotationally moved a further 180° attraction between the magnets is again established, and the clamping action is re-instated.

It is evident that there should preferably be an even number of magnets in each of the first and second sets of planar magnets, so as not to have an uneven number of north or south poles in either set. Indeed, it is found convenient that each magnet set should typically include at least two magnets, and more preferably, four, six, or eight planar magnets.

Further, it can be seen that the magnets are preferably placed in roughly a circle arrangement, and are preferably roughly equally spaced around the optional flux plates. It will also be noted that with greater numbers of magnets, the amount of rotation required to move the buckle assembly from the first predetermined position to the second predetermined position, is decreased.

It can also be noted, that while not preferred, a smaller number of magnets might be positioned in only one section of the flux plate so that the attraction and repulsion forces are localized to one area of the flux plate. This would reduce the number of magnets required, but as would be expected, the total clamping force of the belt buckle would be reduced, and the attractive and repulsive forces would not be even across the buckle. As such, symmetrical placement of the magnets around the flux plate is preferred.

The material of the escutcheon plate, the buckle plate, and the base plate, should preferably not be made of any magnetic material. As such, it has been found particularly convenient for such components to be formed of aluminum, especially where ruggedness and a long operating life are required. However, suitable hard plastics materials such as high density nylon, polyethylene, polypropylene, or copolymers thereof, may also be used. Moreover, the magnets might be encased in plastic, or the like, to eliminate the use of a number of small individual magnets.

As such, there has been described a clamping buckle which is particularly useful for belts such as those worn with clothing, but may also be useful when used in association with strapping and the like. However, other modifications and alterations may be used in the design and manufacture of the apparatus of the present invention without departing from the spirit and scope of the accompanying claims.

Thus, it is apparent that there has been provided, in accordance with the present invention, a buckle which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps. Further, the invention illustratively disclosed herein suitably may be practiced in the absence of any element which is not specifically disclosed herein.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

What is claimed is:

1. A clamping buckle for belts and straps through which a magnetic field will pass, comprising:

a set of at least two first planar magnets, each having a north pole and a south pole at opposed planar faces;

a buckle plate having openings formed therein wherein each opening is sized so as to accommodate one planar magnet;

a set of at least two second planar magnets, each having a north pole and a south pole at opposed planar faces; and a base plate having openings formed therein wherein each opening is sized so as to accommodate one planar magnet;

wherein, when assembled and in its clamping condition, the north poles of the first planar magnets are in facing relation and magnetic attraction to the south poles of the second planar magnets, and vice versa, with a opening for a belt or strap to be positioned therebetween;

wherein said buckle plate may be rotationally moved from a first predetermined orientation where said clamping condition exists to a second predetermined orientation where no clamping condition exists, and wherein, in the second predetermined orientation the north poles of said first planar magnets are in facing relation to the north poles of said second planar magnets and the south poles of said first planar magnets are in facing relation to the south poles of said second planar magnets, so that magnetic repulsion exists between said first set of planar magnets and said set of second planar magnets;

wherein restraining means is provided on said base plate so as to preclude complete separation of said buckle plate from said base plate, but so as to provide a gap between said buckle plate and said base plate through which a belt or strap may be passed; and wherein slight rotational movement of said buckle plate from said second predetermined orientation will permit a sideways magnetic attraction between north and south poles of the respective first and second planar magnets to become effective, so as to thereby permit continued rotational movement of said buckle plate toward said first predetermined orientation, whereat the north and south poles of the respective first and second sets of planar magnets face each other, and vice versa, whereby the magnetic attraction therebetween will cause the buckle plate to physically move toward said base plate so as to thereby establish a clamping action therebetween against a belt or strap which has been passed through said gap.

2. The clamping buckle of claim 1, wherein there are an even number of magnets in each set of said first and second planar magnets.

3. The clamping buckle of claim 2, wherein there are two planar magnets in each set of said first and second planar magnets.

4. The clamping buckle of claim 2, wherein there are at least four and as many as eight planar magnets in each set of said first and second planar magnets.

5. The clamping buckle of claim 1, wherein detent means are provided so as to preclude inadvertent rotational movement of said buckle plate from said second predetermined orientation, but whereby said slight rotational movement will overcome the action of said detent means so as to thereby permit continued rotational movement toward said first predetermined orientation.

6. The clamping buckle of claim 1, wherein an escutcheon plate is attached to said buckle plate, and wherein the assembly of said escutcheon plate and said buckle plate may be rotationally moved from said first predetermined orientation where said clamping condition exists to said second predetermined orientation where no clamping condition exists.

7. The clamping buckle of claim 6, wherein said escutcheon plate and said buckle plate are secured to each other with said first set of planar magnets being secured therebetween.

8. The clamping buckle of claim 6, wherein said escutcheon plate, said buckle plate, and said base plate are made of a non-magnetic material.

9. The clamping buckle of claim 8, wherein said escutcheon plate, buckle plate, and base plate, are made of aluminum.

10. The clamping buckle of claim 8, wherein said escutcheon plate, buckle plate, and base plate, are made of a hard plastics material.

11. The clamping buckle of claim 1, wherein said buckle plate, and said base plate are made of a non-magnetic material.

12. The clamping buckle of claim 1, wherein said buckle plate has the same number of openings formed therein as there are first planar magnets, and said base plate has the same number of openings formed therein as there are second planar magnets.

13. The clamping buckle of claim 1, wherein a first magnetic flux plate is attached to said first set of planar magnets, and a second magnetic flux plate is attached to said second set of planar magnets.

14. The clamping buckle of claim 13 wherein said first magnetic flux plate and said second magnetic flux plate are made of a magnetic material.

15. The clamping buckle of claim 13, wherein each of said first and second sets of planar magnets is arranged around a face of the respective magnetic flux plate so that an outer portion of each magnet is at least proximate to the outer circumference of the respective magnetic flux plate; and so that the respective planar faces of adjacent planar magnets are alternately north and south poles and so that the respective planar faces of the adjacent magnets which are magnetically secured to the respective magnetic flux plate are alternately south and north poles, respectively.

* * * * *